US012660927B2

(12) United States Patent
Aldualeg et al.

(10) Patent No.: US 12,660,927 B2
(45) Date of Patent: Jun. 23, 2026

(54) FOLDABLE CHAIR

(71) Applicant: Imam Abdulrahman Bin Faisal University, Dammam (SA)

(72) Inventors: Asma Abdulaziz Aldualeg, Dammam (SA); Dana Alhussain, Dammam (SA); Hala El-Wakeel, Dammam (SA); Zati Hazirat, Dammam (SA); Lama Alshehri, Dammam (SA)

(73) Assignee: Imam Abdulrahman Bin Faisal University, Dammam (SA)

( * ) Notice: Subject to any disclaimer, the term of this patent is extended or adjusted under 35 U.S.C. 154(b) by 173 days.

(21) Appl. No.: 18/737,221

(22) Filed: Jun. 7, 2024

(65) Prior Publication Data

US 2025/0375039 A1 Dec. 11, 2025

(51) Int. Cl.

| | |
|---|---|
| ***A47C 4/32*** | (2006.01) |
| *A47C 3/16* | (2006.01) |
| *A47C 4/42* | (2006.01) |

(52) U.S. Cl.
CPC ..... *A47C 4/32* (2013.01); *A47C 3/16* (2013.01); *A47C 4/42* (2013.01)

(58) Field of Classification Search
CPC .... A47C 4/32; A47C 4/00; A47C 4/42; A47C 3/16
USPC ..... 297/16.1, 16.2, 17
See application file for complete search history.

(56) References Cited

U.S. PATENT DOCUMENTS

D116,558 S * 9/1939 Ficks ..... 5/419
D167,514 S * 8/1952 Hicks ..... D6/368
3,092,224 A * 6/1963 O'Neil ..... A47C 1/146 297/118

(Continued)

FOREIGN PATENT DOCUMENTS

JP 11-216041 8/1999
JP 3190962 U 6/2014

(Continued)

OTHER PUBLICATIONS

MISSTA Meditation Chair with Extra Back Support Cushion Fully Foldable (Seat Size: 20x18 inches) (Cream) ; MISSTA ; Amazon.com ; 7 Pages.

(Continued)

*Primary Examiner* — Jose V Chen
(74) *Attorney, Agent, or Firm* — Oblon, McClelland, Maier & Neustadt, L.L.P.

(57) ABSTRACT

A foldable chair includes a flat back inclined surface, a bottom flat horizontal surface, a cushion component, and a support component including the flat back inclined surface, the bottom flat horizontal surface, and two triangular side supports. Further, the bottom flat horizontal surface is connected to the flat back inclined surface by the two triangular side supports, and each triangular side support includes an upper rotatable connection, and the upper rotatable connections face one another for connecting the flat back inclined surface with the support component. Furthermore, the cushion component includes a bottom cushion resting on the bottom flat horizontal surface, the bottom cushion has a flat portion and an angled portion. Moreover, the bottom flat horizontal surface includes at least two hand grips on opposite edges of a distal end of the bottom flat horizontal surface.

20 Claims, 9 Drawing Sheets

(56) References Cited

U.S. PATENT DOCUMENTS 3,404,915 A * 10/1968 De Souza Filho ..... A47C 4/52 5/418
4,654,907 A * 4/1987 Haugaard ..... A45C 3/10 5/420
4,775,182 A * 10/1988 von Hoffman ..... A47C 1/14 297/380
4,775,188 A * 10/1988 Fuchs ..... A47C 5/005 297/380
4,925,239 A * 5/1990 Powers ..... A47C 1/146 297/29
5,098,153 A * 3/1992 Antoine ..... A47C 4/52 297/125
D330,639 S * 11/1992 Munro ..... 297/188.1
5,190,344 A * 3/1993 Anderson ..... A47C 7/021 297/188.2
5,205,610 A * 4/1993 Reninger ..... A45C 9/00 297/380
5,385,390 A * 1/1995 Freeman ..... A47C 7/021 297/382
5,425,567 A 6/1995 Albecker, III
5,944,384 A * 8/1999 Patterson ..... A47C 3/18 297/217.3
6,164,726 A * 12/2000 Reeves ..... A47C 7/024 297/16.2
6,250,712 B1 * 6/2001 Livington ..... A47C 1/146 5/632
6,390,550 B1 * 5/2002 Paredes, Jr. ..... A47C 9/00 297/423.31
8,262,157 B2 * 9/2012 Novak ..... A47C 1/146 297/16.2
8,678,489 B1 * 3/2014 Skinner ..... A01M 31/02 297/440.22
8,960,784 B1 * 2/2015 De Berry ..... A47C 7/008 297/53
9,918,554 B2 3/2018 Song
2003/0222484 A1 * 12/2003 Gette ..... A47C 7/66 297/16.2
2005/0067864 A1 * 3/2005 Anglin ..... A47C 4/04 297/184.15
2007/0114820 A1 * 5/2007 Kley ..... A47C 4/28 297/16.1
2007/0152479 A1 * 7/2007 Howman ..... A47C 7/425 297/180.11
2008/0036256 A1 * 2/2008 Gold ..... A47D 1/02 297/440.1
2010/0201162 A1 * 8/2010 Leywood ..... A47C 5/005 297/16.1
2011/0193372 A1 * 8/2011 Pizzuto ..... A47C 1/146 297/217.3
2015/0320218 A1 * 11/2015 Taylor ..... A47C 1/146 297/452.1
2022/0039555 A1 * 2/2022 Fritze ..... A47C 4/46
2022/0225773 A1 * 7/2022 Sun ..... A47C 3/025
2023/0000252 A1 * 1/2023 Lirette-Brainard ..... A47C 7/52

FOREIGN PATENT DOCUMENTS

JP 2019-130195 A 8/2019
KR 101424418 B1 * 7/2014 ..... A47C 4/04

OTHER PUBLICATIONS

Kadi Outdoor Gaming Floor Chair with Armrests, Beige, 8.5 Kg ; Kadi Outdoor, Amazon.com ; Apr. 26, 2021 ; 3 Pages.

* cited by examiner

FOLDABLE CHAIR

BACKGROUND

Technical Field

The present disclosure is related to ergonomic solutions, and more particularly, relates to a foldable chair.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Traditional art forms, artists, and craft persons are an integral part of a society. Al-khuss art is one such craft, an important part of history and identity of middle-eastern states. The craft persons practicing Al-khuss craft have to work long continuous hours in uncomfortable positions to produce a finished product from raw materials. This includes cutting the Al-khuss followed by sitting on a floor for weaving and sewing the Al-khuss for extended periods. This remarkable craft takes a toll on the health of Al-khuss craftswomen and craftsmen, as they have to hold improper posture for hours. As a result of the improper posture, vertebral, cervical and lumbar deformities are seen in the Al-khuss craft persons. Further, these artists end up suffering from long term diseases like high blood pressure, diabetes, cardiovascular diseases, high cholesterol, and arthritis. Due to a variety of chronic incurable diseases, a considerable burden of medical expenses falls upon the aforementioned artists. In today's world, medical expenses can represent a substantial burden on those affected by disease, on top of that, these craft persons suffer from loss of work as the diseases progress. Several possible solutions to the above stated problem statement are proposed in the market, such as, exercise, application of heat or cold to an affected area, restriction of movement, medication and surgery. However, none of the above stated solutions permanently or fundamentally resolve the problems and diseases faced by the Al-khuss craft persons.

U.S. Pat. No. 9,918,554B2 discloses a functional chair for human body correction and therapeutic efficacy promotion by applying heat. A heating mechanism to transfer heat to a human body by using a ceramic heating element installed in a sitting plate and a waist plate. A control unit is used to maintain the temperature of the heating mechanism. The prior art document provides enhancements to the immunity of an individual and promotes health by keeping skeletal structure and organs balanced by allowing a user to keep a correct posture when they are sitting on the functional chair. The functional chair applies heat to a structure including the sitting and waist plates as a Korean traditional floor heating system. However, the above disclosed document has limitations in regards to application in the Al-khuss art.

JP11216041A discloses an auxiliary legless-chair cushion including a cushion that includes a thick waist rest. The auxiliary legless-chair cushion includes a second cushion, that includes a hip rest thinner than the waist rest. Further, the second cushion connects to the first cushion. The auxiliary legless-chair includes a third cushion that includes a thigh rest, thicker than the hip rest, and connects to the second cushion. However, the above disclosed document does not describe lumbar support specifically for Al-khuss art applications.

Each of the aforementioned prior arts suffers from one or more drawbacks hindering their adoption. Accordingly, it is one object of the present disclosure to provide a foldable chair which is ergonomically sound, economical, and portable.

SUMMARY

In an exemplary embodiment, a foldable chair is disclosed. The foldable chair includes a flat back inclined surface, a bottom flat horizontal surface, a cushion component, and a support component. The support component includes the flat back inclined surface, the bottom flat horizontal surface, and two triangular side supports. Further, the bottom flat horizontal surface is connected to the flat back inclined surface by the two triangular side supports, and each triangular side support includes an upper rotatable connection. The upper rotatable connections face one another and are configured to connect the flat back inclined surface with the support component. Furthermore, the cushion component includes a bottom cushion resting on the bottom flat horizontal surface. The bottom cushion has a flat portion and an angled portion, and the angled portion is adjacent to the flat back inclined surface. Moreover, the bottom flat horizontal surface includes at least two hand grips with a first hand grip and a second hand grip on opposite edges of a distal end of the bottom flat horizontal surface.

In some embodiments, the support component further includes an upper slat and a lower slat.

In some embodiments, the angled portion of the bottom cushion is configured to provide pelvic support and spine correction.

In some embodiments, the bottom flat horizontal surface further includes at least two hinges with a first hinge located along a width of the bottom flat horizontal surface and a second hinge located at a distance from the first hinge along the width of the bottom flat horizontal surface.

In some embodiments, the bottom flat horizontal surface folds along the first and second hinges to form a bent portion of the bottom flat horizontal surface.

In some embodiments, the bent portion of the bottom flat horizonal surface is configured to be vertically adjustable to provide knee support.

In some embodiments, the flat back inclined surface includes an upper portion and a lower portion.

In some embodiments, the upper portion of the flat back inclined surface extends upwards to support an upper cushion of the cushion component.

In some embodiments, the bottom cushion includes a medium pressure foam.

In some embodiments, the angled portion of the bottom cushion is configured to lift a user's pelvis to decrease pelvic rearward rotation.

In some embodiments, the support component is made of wood.

In some embodiments, the cushion component further includes a fabric covering.

In some embodiments, the upper rotatable connection is configured to fold the flat back inclined surface downwards and parallel with the bottom flat horizontal surface.

In some embodiments, the upper slat connects to an upper portion of each of the two triangular side supports and connects to the flat back inclined surface.

In some embodiments, the lower slat connects to a lower portion of each of the two triangular side supports and extends perpendicularly from the bottom flat horizontal surface.

In some embodiments, the cushion component further includes an upper cushion with a longest dimension of at least 40 centimeters (cm), and the upper cushion covers a top side of the flat back inclined surface.

In another exemplary embodiment, a system is disclosed. The system includes the foldable chair and a lap component. The lap component is comprised of a foldable flat material allowing the lap component to fold into a closed body.

In some embodiments, the lap component further includes a top surface and a bottom surface when folded into the closed body.

In some embodiments, the bottom surface of the closed body is configured to rest on a user's lap and the top surface of the closed body is configured to provide arm support for the user.

In some embodiments, the support for the arm on the top surface of the closed body provides posture correction by preventing the user from hunching over while seated.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1A:
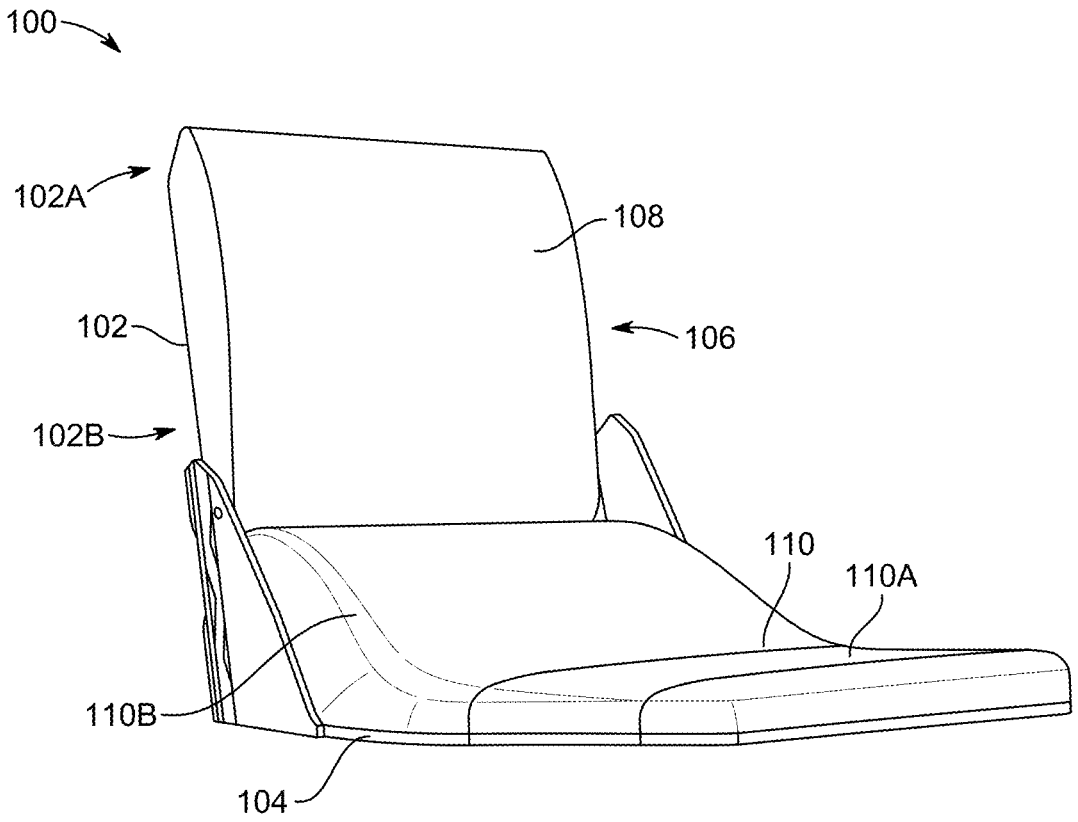
FIG. 1A is a schematic front perspective view of a foldable chair, according to certain embodiments.

In the drawings, like reference numerals designate identical or corresponding parts throughout the several views. Further, as used herein, the words "a", "an" and the like generally carry a meaning of "one or more", unless stated otherwise.

Furthermore, the terms "approximately," "approximate", "about" and similar terms generally refer to ranges that include the identified value within a margin of 20%, 10%, or preferably 5%, and any values therebetween.

Aspects of this disclosure are directed towards a foldable chair designed to provide ergonomic comfort and prevent long-term illnesses incurred due to poor posture, to Al-khuss craft persons. In general, Al-khuss refers to hand-woven palm leaves. Al-khuss is one of the oldest crafts known to mankind, traditionally used to make roofs and floor mats. The foldable chair acts as an ergonomic aid for craft persons who sit on the floor to produce Al-khuss art. The foldable chair as described in the present disclosure preferably uses a wood and fabric construction, however, other suitable materials known in the art may also be used to manufacture the foldable chair.

Referring to FIG. 1A, a schematic front perspective view of a foldable chair 100 is illustrated, according to certain embodiments. In particular, the foldable chair 100 is proposed for craft persons, producing Al-khuss art, while sitting on a flat horizontal surface. The foldable chair 100 includes a plurality of structural components and fastening members. In an embodiment, the foldable chair 100 includes a flat back inclined surface 102. The flat back inclined surface 102 may be alternatively referred to as the backrest of the foldable chair 100. The flat back inclined surface 102 may be arranged, when open, at an incline less than 90 degrees, more preferably between 50 to 80 degrees. Alternatively, when the flat back inclined surface 102 is folded closed, the flat back inclined surface is parallel to the bottom flat horizontal surface 104. The flat back inclined surface 102 may have a height of less than 80 cm, preferably between 30 to 70 cm, and a width of less than 70 cm, preferably 50 to 60 cm. The flat back inclined surface 102 includes an upper portion 102A and a lower portion 102B. The upper portion 102A is configured to support an upper torso of a user and the lower portion 102B is configured to support a lower torso of the user. Further, the foldable chair 100 includes a bottom flat horizontal surface 104. The bottom flat horizontal surface 104 may be alternatively referred to as the body rest of the foldable chair 100. In some embodiments, the flat back inclined surface 102 and the bottom flat horizontal surface 104 are manufactured using wood. However, the flat back inclined surface 102 and the bottom flat horizontal surface 104 may be manufactured using any other suitable material known in the art such as, but not limited to, medium density fiberboard (MDF), high density fiberboard (HDF), metal, metal-alloy, and plastic. The flat back inclined surface 102 and the bottom flat horizontal surface 104 are major structural components for the foldable chair 100. The aforementioned components make up for the back rest and the body rest of the foldable chair 100, as such, a back of the user may rest against the flat back inclined surface 102 and a body of the user may rest upon on the bottom flat horizontal surface 104.

The foldable chair 100 further includes a cushion component 106. The cushion component 106 is manufactured using a compressible solid material such as, but are not limited to, pressure foam, memory foam, and a combination of the pressure foam and the memory foam. The cushion component 106 is configured to support a body weight and a pelvis of the user for elongated periods without showing signs of permanent deformation. In other words, the cushion component 106 regain its original shape after use. In some embodiments, the cushion component 106 further includes separate upper cushion 108 and bottom cushion 110 components. The upper cushion 108 has a longest dimension of 20 to 80 cm, in other words, a length of the upper cushion 108 is about 20 to 80 cm. Preferably, the upper cushion 108 has a longest dimension of at least 30 to 80 cm. In an embodiment, the upper portion 102A of the flat back inclined surface 102 extends upwards to support the upper cushion 108 of the cushion component 106. The upper cushion 108 preferably has a greater length than a length of the flat back inclined surface 102, such that, the upper cushion 108 is configured to cover a top side of the flat back inclined surface 102. Further, the bottom cushion 110 includes a flat portion 110A and an angled portion 110B, configured to detachably couple with the bottom flat horizontal surface 104 with the help of an adhesive or any other attachment mechanism known in the art. In an embodiment, the bottom cushion 110 is manufactured using a medium pressure foam. The angled portion 110B is configured to be adjacent to the flat back inclined surface 102. The angled portion 110B of the bottom cushion 110 is configured to provide pelvic support and spine correction for the user. In particular, the angled portion 110B of the bottom cushion 110 is configured to lift the user's pelvis to decrease pelvic rearward rotation. In general, pelvic rotation or pelvic rearward rotation is defined as the rotation of the pelvis within an axial plane. The rotation may be caused by a plurality of factors such as, but are not limited to, muscular imbalance, asymmetrical leg length, hip flexion, hip adduction, and poor posture.

Figure 1B:
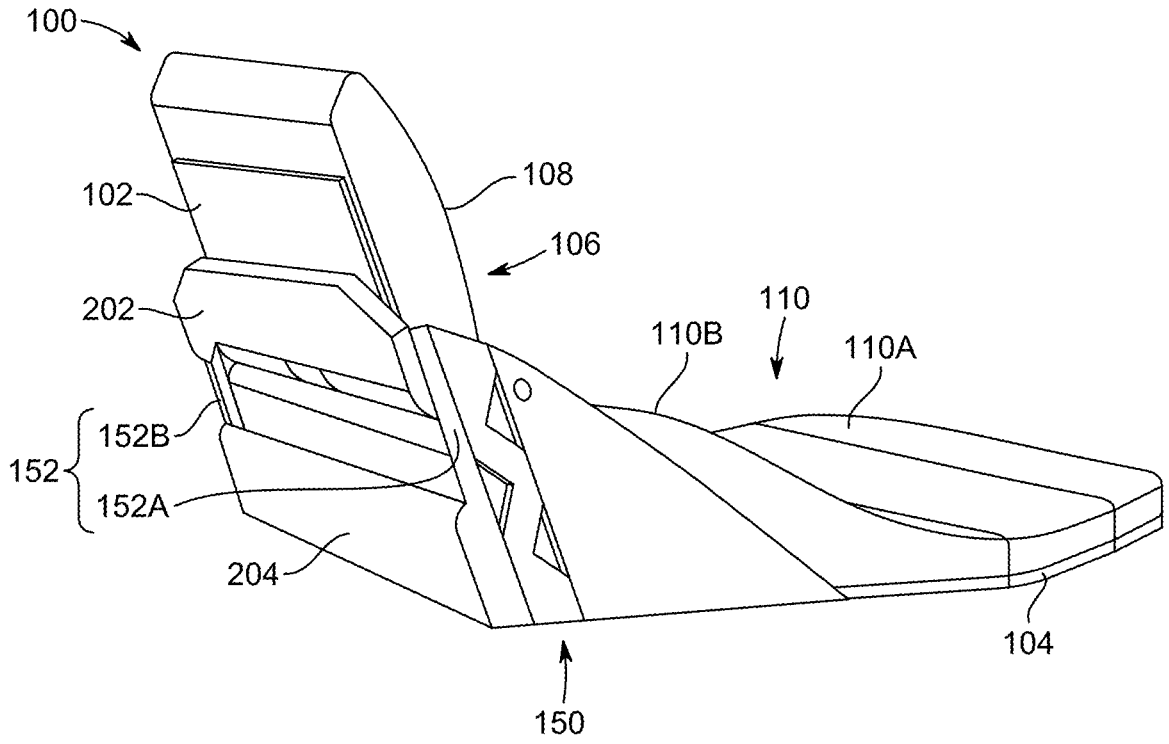
FIG. 1B is a schematic rear perspective view of the foldable chair of FIG. 1A, according to certain embodiments.

Referring to FIG. 1B, a schematic rear perspective view of the foldable chair 100 is illustrated, according to certain embodiments. In an embodiment, the foldable chair 100, as depicted in FIG. 1B, includes a support component 150. The support component 150 is a structural member of the foldable chair 100 and may be alternatively referred to as a frame of the foldable chair 100. The support component 150 is configured to provide structural support to the cushion component 106 and bear the body weight of the user. In some embodiments, the support component 150 includes two triangular side supports 152 and in particular, a first triangular side support 152A and a second triangular side support 152B in conjunction with the flat back inclined surface 102 and the bottom flat horizontal surface 104. The first triangular side support 152A and the second triangular side support 152B are collectively referred to as 'the triangular side supports 152' and individually referred to as 'the triangular side support 152' unless otherwise specifically mentioned. In some embodiments, the flat back inclined surface 102 and the bottom flat horizontal surface 104 are configured to couple with each other via the two triangular side supports 152. In particular, the first triangular side support 152A acts as a joining member between a first end of each of the flat back inclined surface 102 and the bottom flat horizontal surface 104 and the second triangular side support 152B acts as a joining member between a second end of each of the flat back inclined surface 102 and the bottom flat horizontal surface 104 to realize the support component 150. The triangular side supports 152 may be as tall as the flat inclined surface 102, with the upper corner of the triangular side supports 152 meeting the upper end of the flat back inclined surface 102. The triangular side supports 152 alternatively may be shorter than the flat back inclined surface 102, extending to a middle portion of the flat back inclined surface 102. The triangular side supports 152 further attach to the bottom flat horizontal surface 104 and extend roughly 10 to 20 cm down the side of the bottom flat horizontal surface, with the bottom flat horizontal surface 104 extending out past the bottom extended point of the triangular side supports 152. The triangular side supports 152 may have cut outs along the support side attached to the flat back inclined surface 102 that do not interfere with the folding mechanism but provide air flow through the chair to provide increased comfort for the user. According to the present disclosure, the support component 150 is preferably manufactured using wood. However, in some embodiments, the support component 150 may be manufactured using any other suitable material known in the art.

Figure 2:
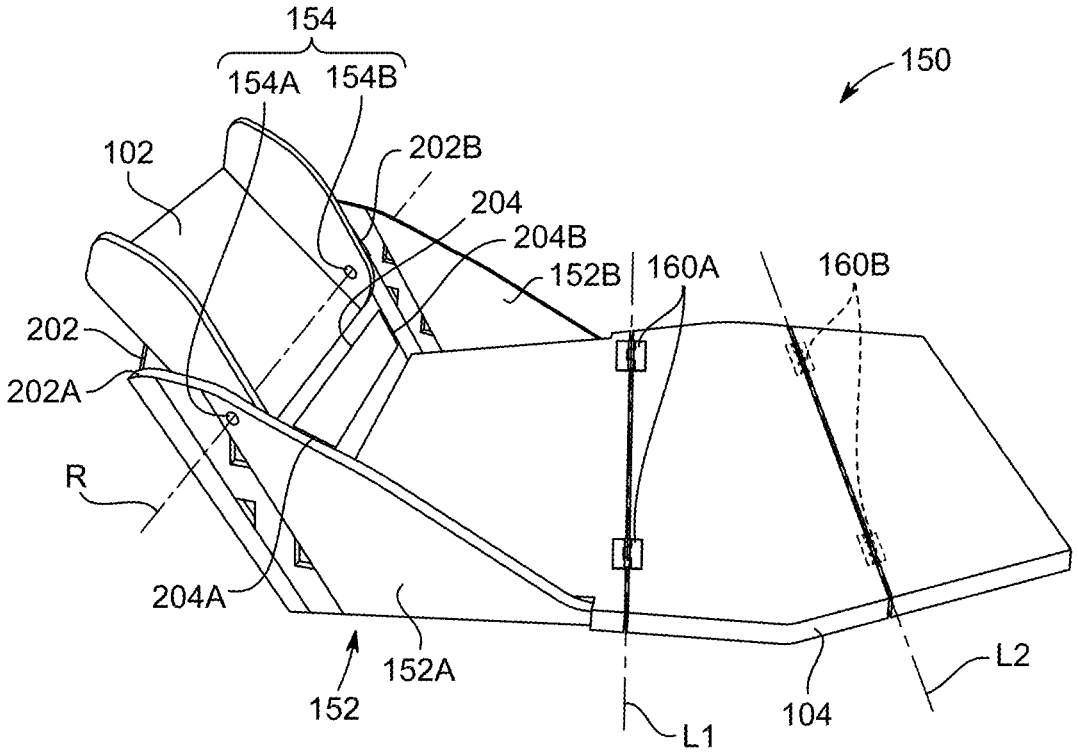
FIG. 2 is a schematic diagram of a support component of the foldable chair of FIG. 1A, according to certain embodiments.

Referring to FIG. 2, a schematic diagram depicting the support component 150 of the foldable chair 100 with additional structural members is illustrated, according to certain embodiments. The support component 150 includes an upper slat 202 and a lower slat 204. In some embodiments, the upper slat 202 is configured to mechanically connect to an upper portion of each of the two triangular side supports 152. In particular, a first end 202A of the upper slat 202 is configured to couple with the first triangular side support 152A and a second end 202B of the upper slat 202 is configured to couple with the second triangular side support 152B. In addition, the upper slat 202 may be configured to detachably couple to the flat back inclined surface 102. The upper slat 202 is configured to provide structural bracing to the foldable chair 100 and additional support to the flat back inclined surface 102. The upper slat 202 and lower slat are arranged at an angle, preferably less than 90 degrees, more preferably between 60 and 80 degrees, consistent with the angle of the flat back inclined surface 102. The upper slat 202 is manufactured using wood, however, the upper slat 202 may be manufactured using any other suitable material known in the art. The lower slat 204 and the upper slat 202 are both truncated to provide a gap between the two slats. The gap between the lower slat and the upper slat 202 may provide a handle for transporting the chair when folded closed.

In some embodiments, the lower slat 204 is configured to mechanically connect to a lower portion of each of the two triangular side supports 152. In particular, a first end 204A of the lower slat 204 is configured to couple with the first triangular side support 152A and a second end 204B of the lower slat 204 is configured to couple with the second triangular side support 152B. In addition, the lower slat 204 is configured to perpendicularly extend from the bottom flat horizontal surface 104 in an upward direction. In an embodiment, the lower slat 204 is positioned to provide support to the angled portion 110B of the bottom cushion 110.

The first triangular side support 152A includes a first upper rotatable connection 154A rotatable along an axis 'R'. Further, the second triangular side support 152B includes a second upper rotatable connection 154B rotatable along the axis 'R'. The first and second upper rotatable connections 154A, 154B are collectively referred to as 'the upper rotatable connection 154' and individually referred to as the first upper rotatable connection 154A and the second upper rotatable connection 154B. In addition, the first upper rotatable connection 154A configured on the first triangular support 152A faces the second upper rotatable connection 154B configured on the second triangular support 152B, as such, the flat back inclined surface 102 is rotatably coupled with the support component 150 via the upper rotatable connection 154. Further, the bottom flat horizontal surface 104 of the support component 150 includes at least two hinges 160. The two hinges 160 may include a first hinge 160A and a second hinge 160B, or be a single piano style hinge having extended length. The first hinge 160A is configured to be positioned along a width of the bottom flat horizontal surface 104 and along a first longitudinal axis 'L1' for providing bending and folding capabilities to the bottom flat horizontal surface 104 along the first longitudinal axis 'L1' in an upward direction. In some embodiments, multiple first hinges 160A may be configured to be positioned at pre-determined distances along the width of the bottom flat horizontal surface 104. In particular, the multiple first hinges 160A may be positioned in a straight line along the first longitudinal axis 'L1'.

In some embodiments, the second hinge 160B located at a distance from the first hinge 160A along the width of the bottom flat horizontal surface 104 and along a second longitudinal axis 'L2' for providing bending and folding capabilities to the bottom flat horizontal surface 104 along the second longitudinal axis 'L2' in a downward direction. In some embodiments, multiple second hinges 160B may be configured to be positioned at pre-determined distances along the width of the bottom flat horizontal surface 104. In particular, the multiple second hinges 160B may be positioned in a straight line along the second longitudinal axis 'L2'. As such, the first and second hinges 160A, 160B allow the bottom flat horizontal surface to bend in upward and downward directions.

Figure 3A:
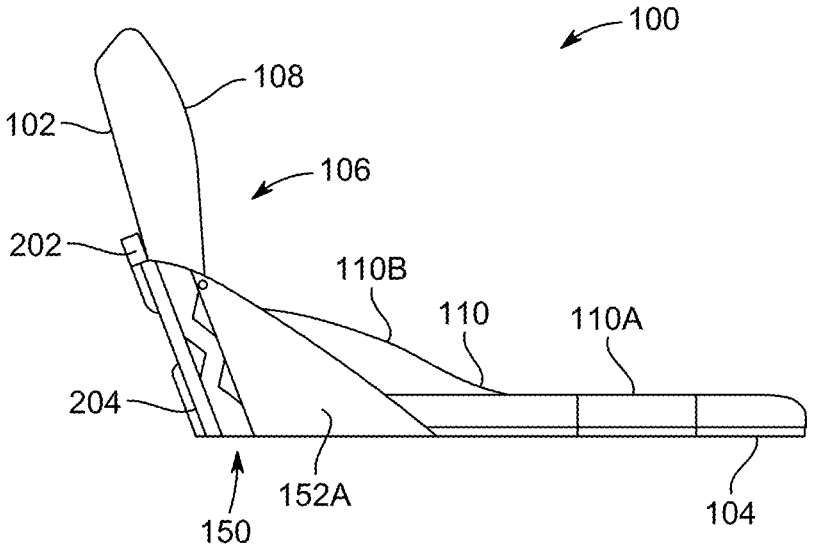
FIG. 3A is a schematic side view of the foldable chair of FIG. 1A, according to certain embodiments.
Figure 3B:
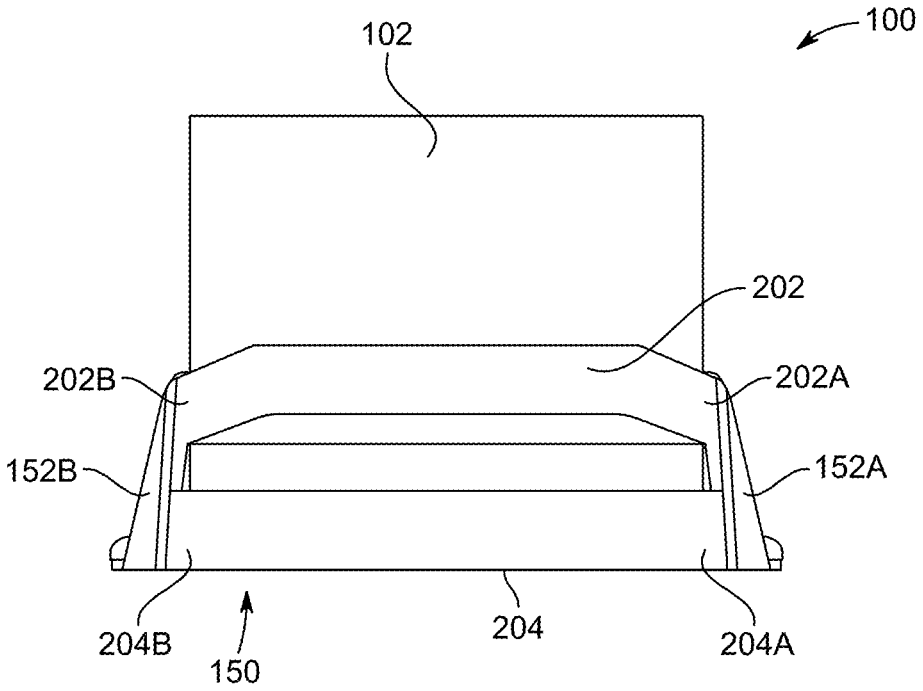
FIG. 3B is a schematic rear view of the foldable chair of FIG. 1A, according to certain embodiments.
Figure 3C:
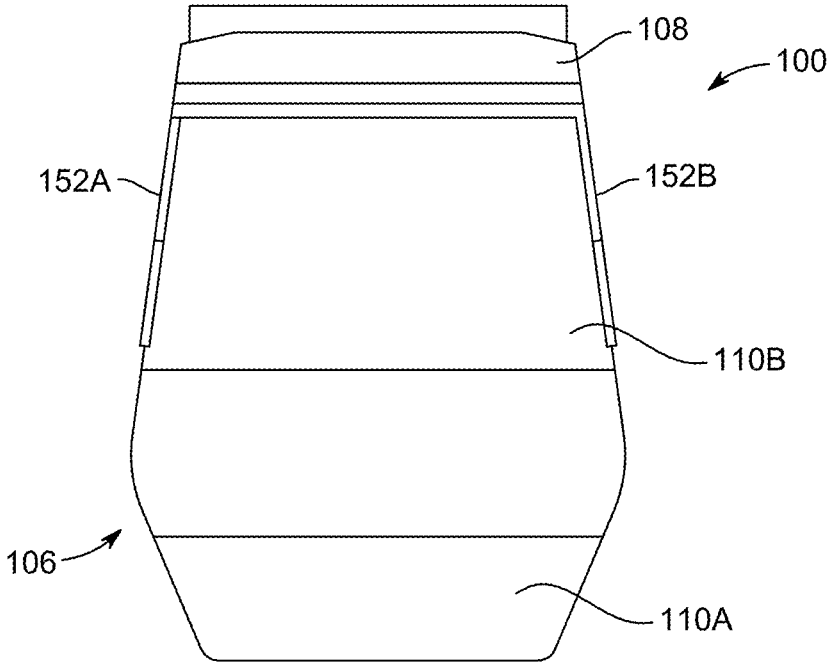
FIG. 3C is a schematic top view of the foldable chair of FIG. 1A, according to certain embodiments.

Referring to FIG. 3A, FIG. 3B, and FIG. 3C, a side view, a rear view, and a top view, respectively, of the foldable chair 100 are illustrated, according to certain embodiments. FIG. 3A, FIG. 3B, and FIG. 3C provide more details about the dimensional specifications of the foldable chair 100. Referring to FIG. 3A, a total height of the foldable chair including the flat back inclined surface 102 and the support component 150 is about 40 to 80 centimeters (cm), more preferably 45 to 55 cm. The angled portion 110B of the bottom cushion 110 and the bottom flat horizontal surface 104 have a combined height of about 10 to 30 cm. The flat portion 110A of the bottom cushion 110 and the bottom flat horizontal surface 104 have a combined height of about 5 to 10 cm, more preferably 5 to 7 cm. Further, referring to FIG. 3B, a total width of the foldable chair 100 is about 50 to 90 cm, more preferably 60 to 80 cm, a total width of the flat back inclined surface 102 is about 40 to 70 cm, more preferably 50 to 60 cm, and the support component 150 of the foldable chair 100 has a width of about 40 to 80 cm, more preferably 50 to 70 cm. Furthermore, referring to FIG. 3C, a total length of the foldable chair 100 is about 60 to 90 cm, more preferably 70 to 80 cm, and the bottom flat horizontal surface 104 with the bottom cushion 110 have a combined length of about 50 to 80 cm, more preferably 60 to 70 cm. In some embodiments, the length, height, and width dimensions of the foldable chair 100 may vary based on various factors including, but not limited to, application of the foldable chair 100, body weight and size of the user, and material of the foldable chair 100.

Figure 4A:
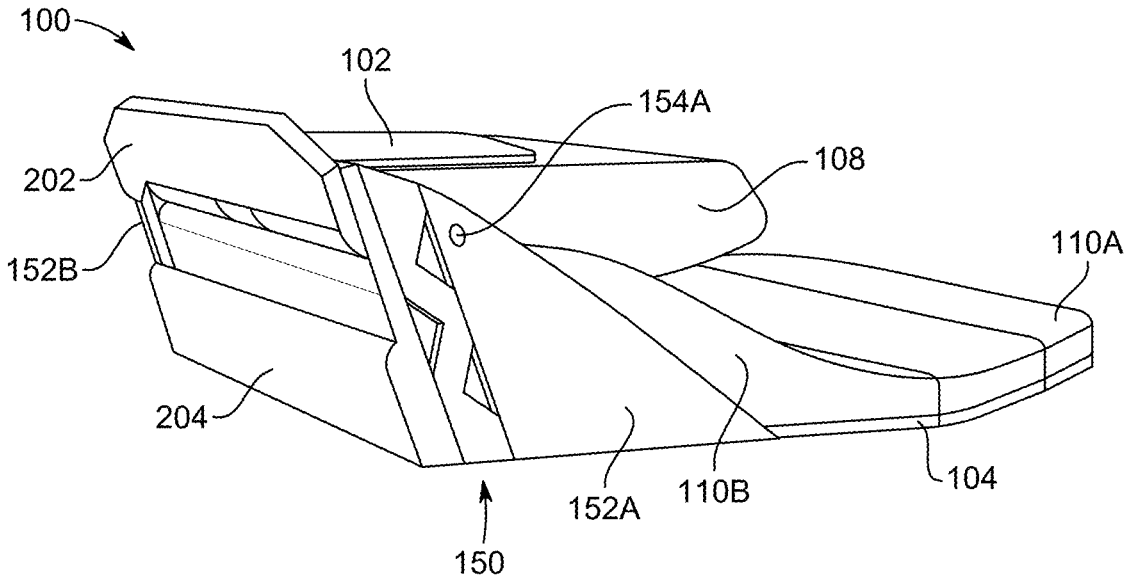
FIG. 4A is a schematic rear perspective view of the foldable chair of FIG. 1A showing a folded configuration, according to certain embodiments.

Referring to FIG. 4A, a schematic rear perspective view of the foldable chair 100 in a folded configuration is illustrated, according to certain embodiments. As can be seen from FIG. 4A, the flat back inclined surface 102 with the upper cushion 108 is folded downwards and parallel to the bottom flat horizontal surface 104 and the bottom cushion 110. The upper rotatable connection 154 configured in the upper portion of the first and second triangular side supports 152A, 152B provide the folding capabilities to the flat back inclined surface 102. In other words, the upper rotatable connection 154 are configured to fold the flat back inclined surface 102 in downwards and parallel with the bottom flat horizontal surface 104. The foldable nature of the foldable chair 100 may provide flexibility to the user, in storage and transportation of the foldable chair 100. Further, the foldable nature may prevent dust and dirt particles from settling upon a plurality of surfaces of the foldable chair 100.

Figure 4B:
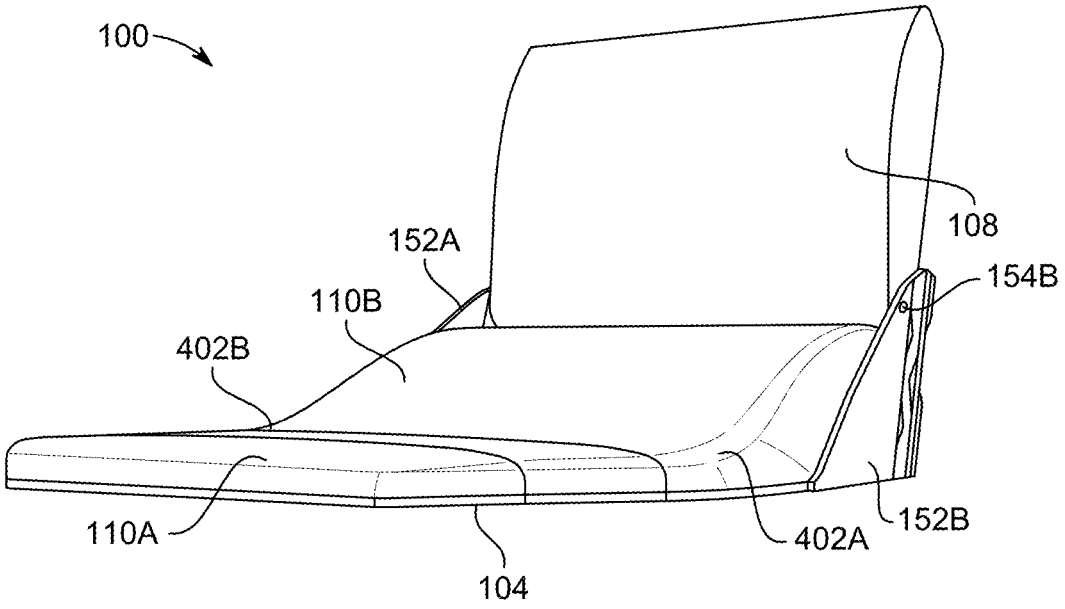
FIG. 4B is a schematic perspective view of the foldable chair of FIG. 1A showing one or more hand grips, according to certain embodiments.

Referring to FIG. 4B, a schematic front perspective view of the foldable chair 100 depicting one or more hand grips is illustrated, according to certain embodiments. In particular, the bottom flat horizontal surface 104 has at least two hand grips. The two hand grips include a first hand grip 402A and a second hand grip 402B, configured to be positioned on opposite edges of a distal end of the bottom flat horizontal surface 104. In other words, the first hand grip 402A is positioned on a first edge of the bottom flat horizontal surface 104 and the second hand grip 402B is positioned on a second edge of the bottom flat horizontal surface 104. Both the first and the second edges are defined at distal end of the bottom flat horizontal surface 104. The distal end of the bottom flat horizontal surface 104 may be defined as a rear end of the bottom flat horizontal surface 104 attached to the two triangular side supports 152. The first 402A and second 402B hand grips may be recessed sections on the bottom flat horizontal surface 104 near the base of the triangular side supports 152, allowing for the user to place their hands on the bottom flat horizontal surface 104 while sitting. In another embodiment, the first hand grip 402A and second hand grip 402B may be built into the bottom cushion 110B, providing a crevice along the length of the bottom cushion 110B near the side of the bottom flat horizontal surface 104.

Figure 5:
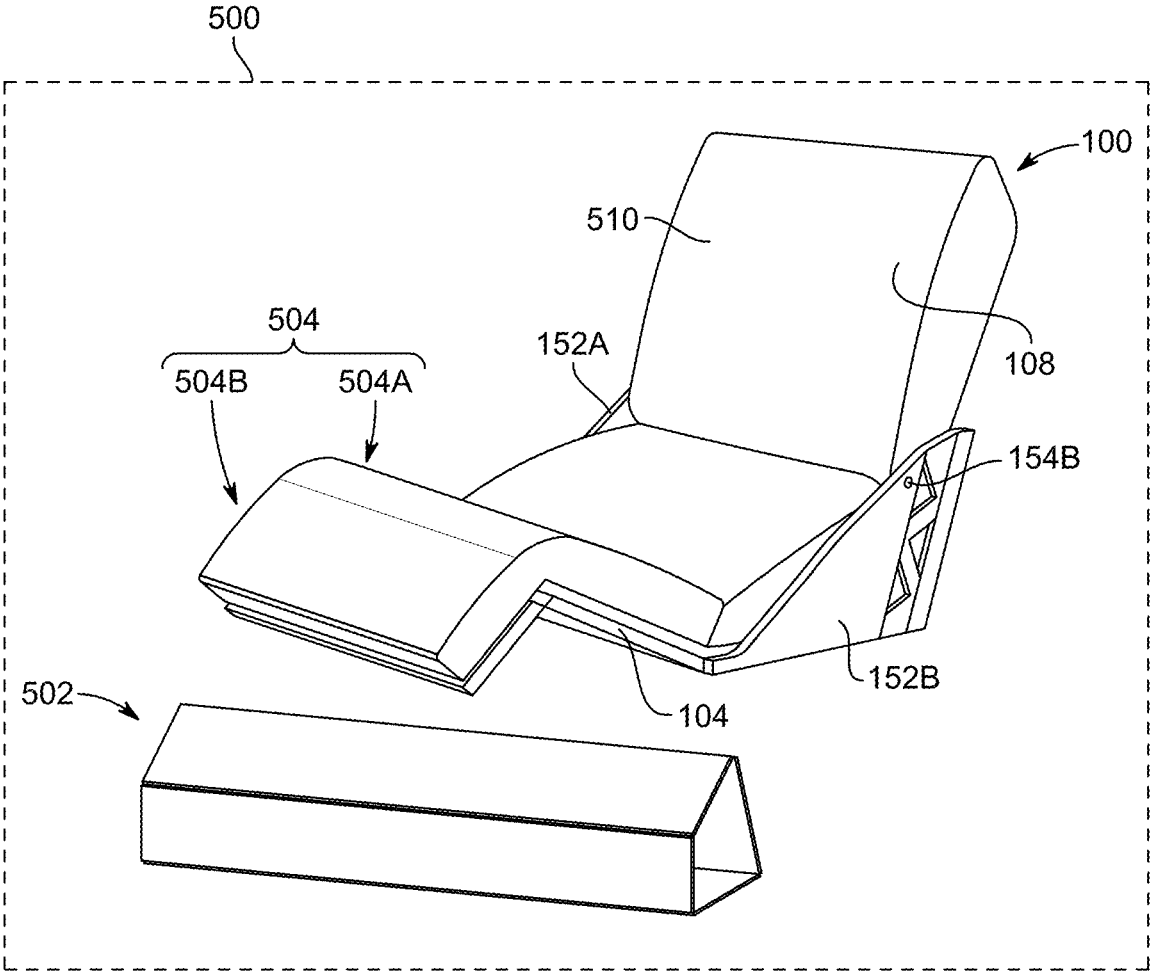
FIG. 5 is a schematic diagram of a system including the foldable chair and a lap component, according to certain embodiments.

Referring to FIG. 5, a schematic perspective view of a system 500 is illustrated, according to certain embodiments. The system 500 includes a lap component 502 and the foldable chair 100. In some embodiments, the foldable chair 100 includes at least two bent portions 504. The two bent portions 504 includes a first bent portion 504A and a second bent portion 504B in the bottom flat horizontal surface 104 and the bottom cushion 110 disposed thereon. The first bent portion 504A is formed by bending the bottom flat horizontal surface 104 along the first hinges 160A and the second bent portion 504B is formed by bending the bottom flat horizontal surface 104 along the second hinges 160B. In some embodiments, the bent portions 504 of the bottom flat horizontal surface 104 is configured to be vertically adjustable to provide knee support to the user. In particular, a height and an angle of the bent portions 504 are adjustable as per the physical support needed by the user. In some embodiments, a sliding and locking mechanism may be provided in the bottom flat horizontal surface 104 to vertically adjust the bent portions 504 and lock a position of the bent portions 504 intact to provide the knee support. Further, the cushion component 106 of the foldable chair 100 includes a fabric covering 510. The fabric covering 510 may be configured to protect the material of the cushion component 106 from environmental factors such as, but are not limited to, dust, dirt, and moisture components. The fabric covering 510 may provide aesthetic appeal to the appearance of the foldable chair 100. The fabric covering 510 may be manufactured using, but are not limited to, jute, cotton, wool, and synthetic fibers. The fabric covering 510 may be washable to enhance the longevity of the fabric covering 510 and to clear any accumulated foreign particles such as, but not limited to, dust, dirt, and dead-skin particles.

Figure 6A:
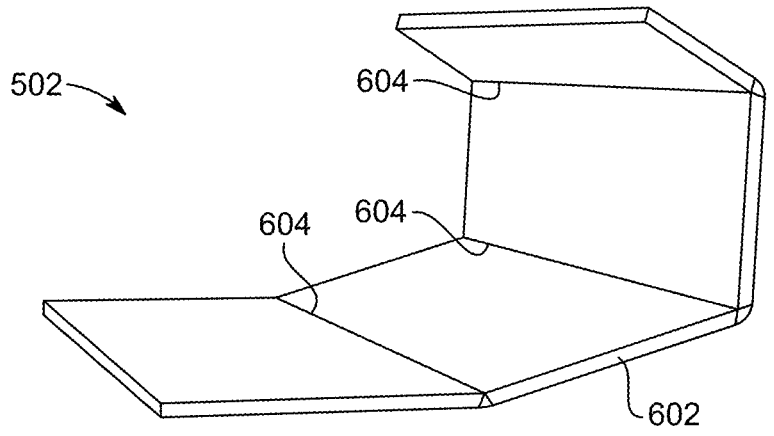
FIG. 6A is a schematic perspective view of the lap component showing an open configuration thereof, according to certain embodiments.

Referring to FIG. 6A, a schematic perspective view of the lap component 502 in an open configuration is illustrated, according to certain embodiments. The lap component 502 includes a foldable flat material 602 allowing the lap component 502 to fold into a closed body. The foldable flat material 602 may refer to a solid material with a plurality of creases 604 defined at pre-determined distances, in order to allow the solid material to fold therefrom. In some embodiments, the solid material may include, but are not limited to, wood, plastic, metal, or metal alloys. The solid material may be further covered with a fabric to make the lap component 502 safe and convenient to use, which would otherwise cause injuries to the user due to sharp edges of the solid material. As shown in FIG. 6A, the lap component 502 is in the form of a rectangular sheet with the plurality of creases 604 defined along a width of the lap component 502. In particular, the lap component 502 includes three creases to define four bending portions and thereby to define four side surfaces when folded into the closed body. In some embodiments, free ends of the lap component 502 may be provided with a locking or connecting mechanism to lock the foldable flat material 602 into a closed configuration of the lap component 502. When the chair is folded closed, the lap component 502 may be placed between the folded upper cushion and bottom cushion, held between the two in the closed position. In another embodiment, the lap component 502 may be attached to the flat back inclined surface by a sticking mechanism. In one embodiment the sticking mechanism may be a strip of hook and loop tape attached to the flat back inclined surface 102 and one side of the lap component 502. In another embodiment, the sticking mechanism may be a series of snaps aligned on the lap component 502 and the flat back inclined surface 102 or a string attached to either side of the closed lap component 502 that may be tied around the flat back inclined surface 102.

Figure 6B:
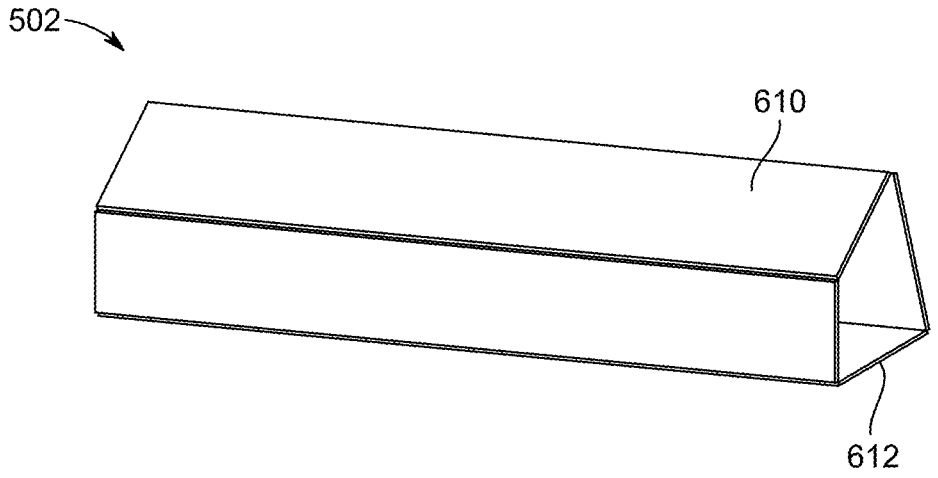
FIG. 6B is a schematic perspective view of the lap component showing a closed configuration thereof, according to certain embodiments.

Referring to FIG. 6B, a schematic perspective view of the lap component 502 showing the closed configuration thereof, is illustrated, according to certain embodiments. The lap component 502, when folded into the closed body, includes a top surface 610 and a bottom surface 612. The top surface 610 of the closed body is configured to provide arm support to the user and the bottom surface 612 of the closed body is configured to rest on a lap of the user. In other words, when the user is seated on the foldable chair 100, the user may use the lap component 502 such that, the bottom surface 612 of the closed body rests on the lap of the user and the top surface 610 of the closed body simultaneously provides arm support to the user. The arm support provided by the top surface 610 of the closed body prevents the user from hunching over while seated, which in turn, provides posture correction to the user. Further, the posture correction provided by the closed body of the lap component 502 prevents the user from developing multiple health problems, such as, but are not limited to, back ache, arthritis, slip disc, and curved back.

The foldable chair 100 of the present disclosure may find wide ranging application throughout the art and craft industry, involving extended time periods of working while sitting on a floor or a plurality of flat horizontal surfaces. The foldable chair 100 may be an economical and low maintenance ergonomic aid, preventing young craft persons from developing posture related illnesses and may assist in healing process of individuals with existing posture related illnesses. Apart from the art and craft industry, the foldable chair 100 may be used by people having poor posture, back problems, and other posture related illnesses.

While aspects of the present disclosure have been particularly shown and described with reference to the embodiments above, it will be understood by those skilled in the art that various additional embodiments may be contemplated by the modification of the disclosed methods and systems without departing from the spirit and scope of what is disclosed. Such embodiments should be understood to fall within the scope of the present disclosure as determined based upon the claims and any equivalents thereof.

The invention claimed is:

1. A foldable chair comprising:

a flat back inclined surface, a bottom flat horizontal surface, a cushion component, and a support component comprising the flat back inclined surface, the bottom flat horizontal surface, and two triangular side supports, wherein the bottom flat horizontal surface is connected to the flat back inclined surface by the two triangular side supports, wherein each triangular side support comprises an upper rotatable connection, wherein the upper rotatable connections face one another and are configured to connect the flat back inclined surface with the support component, wherein the cushion component further comprises a bottom cushion resting on the bottom flat horizontal surface, wherein the bottom cushion has a flat portion and an angled portion, wherein the angled portion is adjacent to the flat back inclined surface, and wherein the bottom flat horizontal surface further comprises at least two hand grips with first and second hand grips on opposite edges of a distal end of the bottom flat horizontal surface.

2. The foldable chair of claim 1, wherein the support component further comprises an upper slat and a lower slat.

3. The foldable chair of claim 2, wherein the upper slat connects to an upper portion of each of the two triangular side supports and connects to the flat back inclined surface.

4. The foldable chair of claim 2, wherein the lower slat connects to a lower portion of each of the two triangular side supports and extends perpendicularly from the bottom flat horizontal surface.

5. The foldable chair of claim 1, wherein the angled portion of the bottom cushion is configured to provide pelvic support and spine correction.

6. The foldable chair of claim 1, wherein the bottom flat horizontal surface further comprises at least two hinges with a first hinge located along a width of the bottom flat horizontal surface and a second hinge located at a distance from the first hinge along the width of the bottom flat horizontal surface.

7. The foldable chair of claim 6, wherein the bottom flat horizontal surface folds along the first and second hinges to form a bent portion of the bottom flat horizontal surface.

8. The foldable chair of claim 7, wherein the bent portion of the bottom flat horizonal surface is configured to be vertically adjustable to provide knee support.

9. The foldable chair of claim 1, wherein the flat back inclined surface comprises an upper portion and a lower portion.

10. The foldable chair of claim 9, wherein the upper portion of the flat back inclined surface extends upwards to support an upper cushion of the cushion component.

11. The foldable chair of claim 1, wherein the bottom cushion comprises a medium pressure foam.

12. The foldable chair of claim 1, wherein the angled portion of the bottom cushion is configured to lift a user's pelvis to decrease pelvic rearward rotation.

13. The foldable chair of claim 1, wherein the support component is made of wood.

14. The foldable chair of claim 1, wherein the cushion component further comprises a fabric covering.

15. The foldable chair of claim 1, wherein the upper rotatable connection is configured to fold the flat back inclined surface downwards and parallel with the bottom flat horizontal surface.

16. The foldable chair of claim 1, wherein the cushion component further comprises an upper cushion with a longest dimension of at least 40 centimeters (cm), and wherein the upper cushion covers a top side of the flat back inclined surface.

17. A system, comprising:

the foldable chair of claim 1, and a lap component wherein the lap component is comprised of a foldable flat material allowing the lap component to fold into a closed body.

18. The system of claim 17, wherein the lap component further comprises a top surface and a bottom surface when folded into the closed body.

19. The system of claim 18, wherein the bottom surface of the closed body is configured to rest on a user's lap and the top surface of the closed body is configured to provide arm support for the user.

20. The system of claim 19, wherein the top surface of the closed body provides posture correction by preventing the user from hunching over while seated.

* * * * *